US008581787B2

(12) United States Patent
Hsiung

(10) Patent No.: US 8,581,787 B2
(45) Date of Patent: Nov. 12, 2013

(54) PORTABLE ELECTRONIC DEVICE WITH ANTENNA MODULE

(75) Inventor: Ming-Chun Hsiung, Shindian (TW)

(73) Assignee: FIH (Hong Kong) Limited, Kowloon (HK)

( * ) Notice: Subject to any disclaimer, the term of this patent is extended or adjusted under 35 U.S.C. 154(b) by 511 days.

(21) Appl. No.: 12/891,903

(22) Filed: Sep. 28, 2010

(65) Prior Publication Data

US 2012/0001806 A1 Jan. 5, 2012

(30) Foreign Application Priority Data

Jun. 30, 2010 (CN) ..... 2010 2 0242992

(51) Int. Cl.
*H01Q 1/24* (2006.01)

(52) U.S. Cl.
USPC ..... 343/702; 343/700 MS; 343/846

(58) Field of Classification Search
USPC ..... 343/702, 700 MS, 846
See application file for complete search history.

(56) References Cited

U.S. PATENT DOCUMENTS

| | | | | |
|---|---|---|---|---|
| 7,371,090 | B2 * | 5/2008 | Hashizume | 439/164 |
| 2006/0077106 | A1 * | 4/2006 | Park | 343/702 |
| 2009/0267843 | A1 * | 10/2009 | Wu et al. | 343/702 |
| 2010/0304792 | A1 * | 12/2010 | Li et al. | 455/566 |

OTHER PUBLICATIONS

Goteti et al, MEMS-Based Frequency Switchable Microstrip Patch Antenna Fabricated Using Printed Circuit Processing Techniques, 2006, IEEE Antennas and Wireless Propagation Letters, vol. 5, pp. 228-230.*

* cited by examiner

*Primary Examiner* — Jerome Jackson, Jr.
*Assistant Examiner* — Hai Tran
(74) *Attorney, Agent, or Firm* — Altis & Wispro Law Group, Inc.

(57) ABSTRACT

A portable electronic device includes a main body, and an antenna module. The main body includes an upper surface and a lower surface. A recessed portion is formed in the upper surface and a receiving portion is formed in the lower surface. The antenna module includes an antenna and a holder. The antenna is attached to the holder. The holder includes a first end portion and a second end portion. The first end portion and the second end portion are respectively engaged in the recessed portion and the receiving portion. A connector electronically connects the antenna.

20 Claims, 5 Drawing Sheets

PORTABLE ELECTRONIC DEVICE WITH ANTENNA MODULE

BACKGROUND

1. Technical Field

The present disclosure relates to an antenna module used in a portable electronic device.

2. Description of Related Art

Antennas are installed in portable electronic devices to send/receive wireless signals. Generally, the antennas may send/receive wireless signals of different frequencies (e.g., DCS1800, PCS1900, UMTS2100, etc.), requiring that the antennas be multiband antennas.

However, most conventional multiband antennas have complicated structures and are large, despite most current portable electronic devices being small with insufficient space to install the multiband antennas. Even if some miniaturized multiband antennas can be installed in the portable electronic devices, they are difficult to install with precision, and communication quality of the portable electronic devices may be affected.

Therefore, there is room for improvement within the art.

BRIEF DESCRIPTION OF THE DRAWINGS

Many aspects of the antenna module can be better understood with reference to the following drawings. The components in the drawings are not necessarily drawn to scale, the emphasis instead being placed upon clearly illustrating the principles of the antenna module.

DETAILED DESCRIPTION

Figure 1:
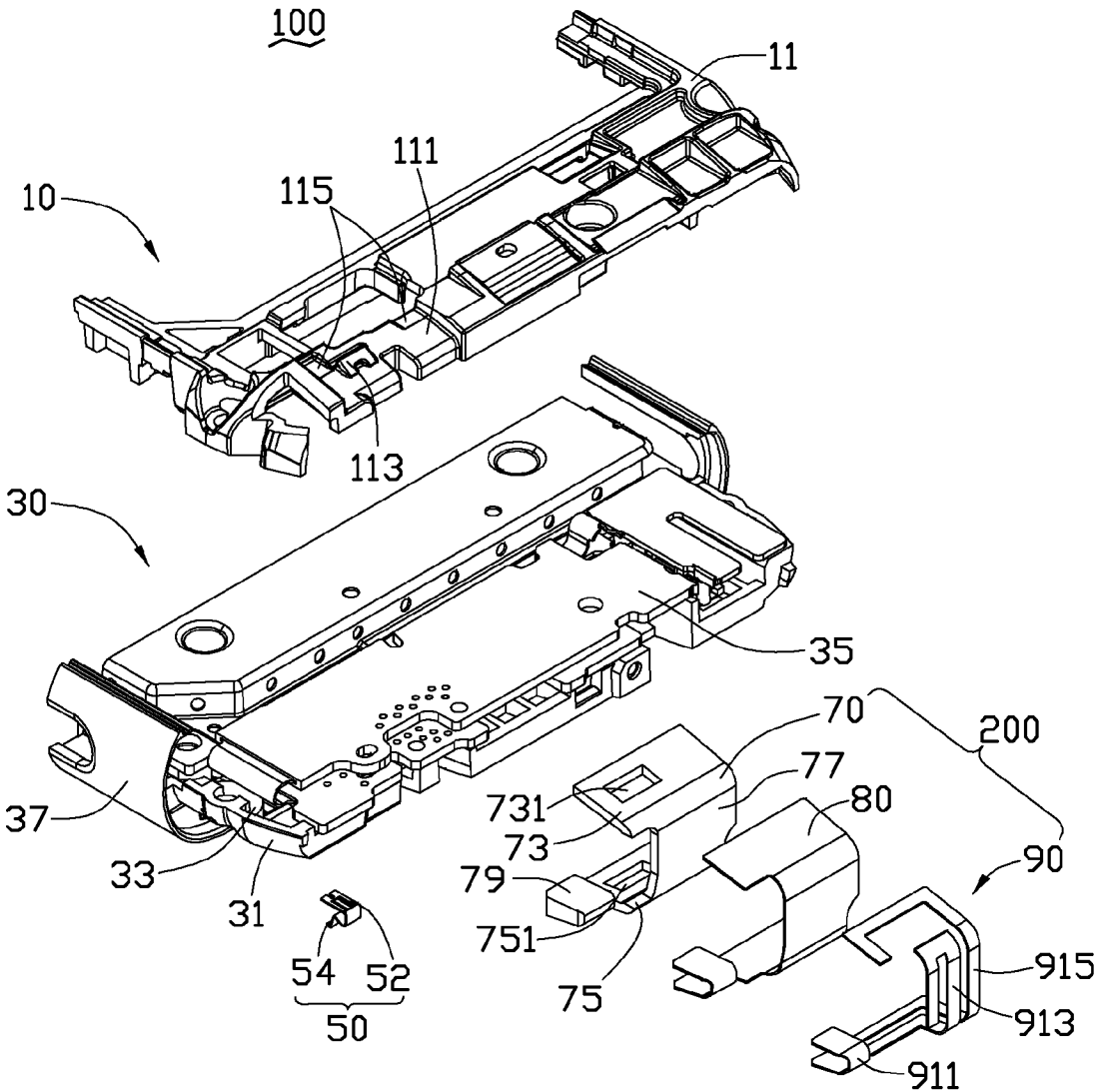
FIG. 1 is an exploded, isometric view of one portion of a portable electronic device with an antenna module, the portable electronic device including a housing and a cover, in accordance with an exemplary embodiment.

FIG. 1 shows an exemplary embodiment of an antenna module 200 incorporated within a portable electronic device 100. The portable electronic device 100 may be a mobile phone, a personal digital assistant (PDA). In the exemplary embodiment, the portable electronic device 100 is a mobile phone. The antenna module 200 is installed in the portable electronic device 100 to send/receive wireless signals.

The portable electronic device 100 includes a cover 10, a housing 30 and a connector 50. The connector 50 is used to electronically connect the antenna module 200 to a printed circuit board 35 mounted on the housing 30. The connector 50 is a metal plate, and includes a main plate 52 and a finger end 54 at one end of the main plate 52.

The cover 10 includes an upper surface 11. A recessed portion 111 is defined in the upper surface 11. The recessed portion 111 respectively defines two grooves 115, one at each side thereof. A protrusion 113 is formed on the recessed portion 111.

Figure 2:
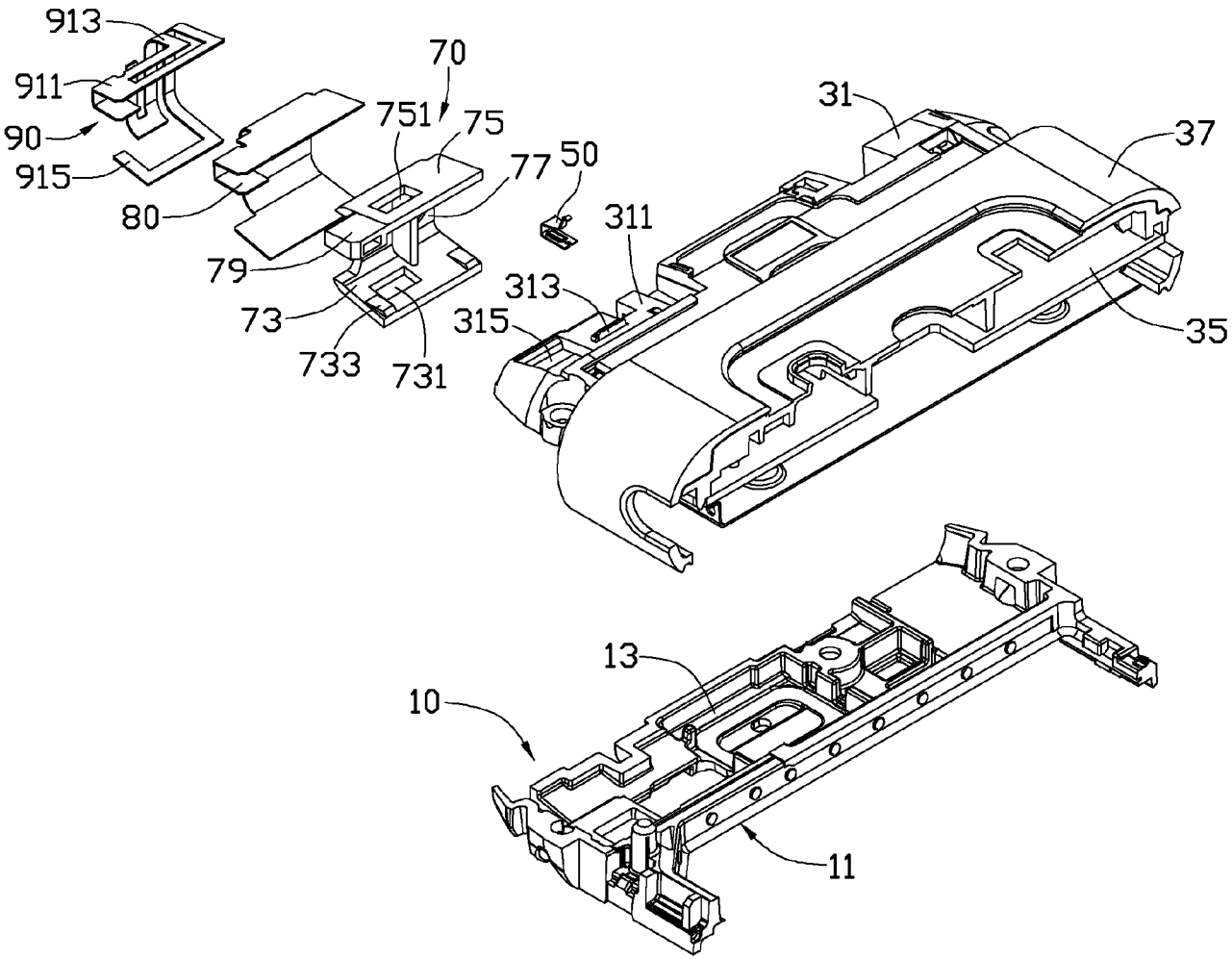
FIG. 2 is similar to FIG. 1, but shown from another aspect.

Also, referring to FIG. 2, the housing 30 defines a through hole 315 beside the printed circuit board 35. The housing 30 includes a lower surface 31. A receiving portion 311 is defined in the lower surface 31. The through hole 315 communicates with the receiving portion 311. A projecting portion 313 is formed on the receiving portion 311. An arcuate shell 37 is positioned at each side of the housing 30.

The antenna module 200 includes an antenna 90, a transparent film 80, and a holder 70. The holder 70 is the carrier of the antenna 90 and the transparent film 80.

The antenna 90 includes a feed portion 911, a first radiator 913 and a second radiator 915. The first radiator 913 and the second radiator 915 extend from the feed portion 911, but are separated from each other. The first radiator 913 and the second radiator 915 have different lengths to generate signals of different resonant frequencies in response to radio frequency signals fed in the feed portion 911. The feed portion 911 is U-shaped.

The holder 70 includes a first end portion 73, a second end portion 75 and a connecting portion 77 connecting with the first, second end portions 73, 75. The first end portion 73 and the second end portion 75 respectively define a first latching hole 731 and a second latching hole 751. A block 79 is positioned adjacent to the second end portion 75 allowing the U-shaped feed portion 911 mounted thereon. Two wedges 733 are respectively formed at two sides of the first end portion 73 for engaging with the grooves 115 of the cover 10.

Figure 3:
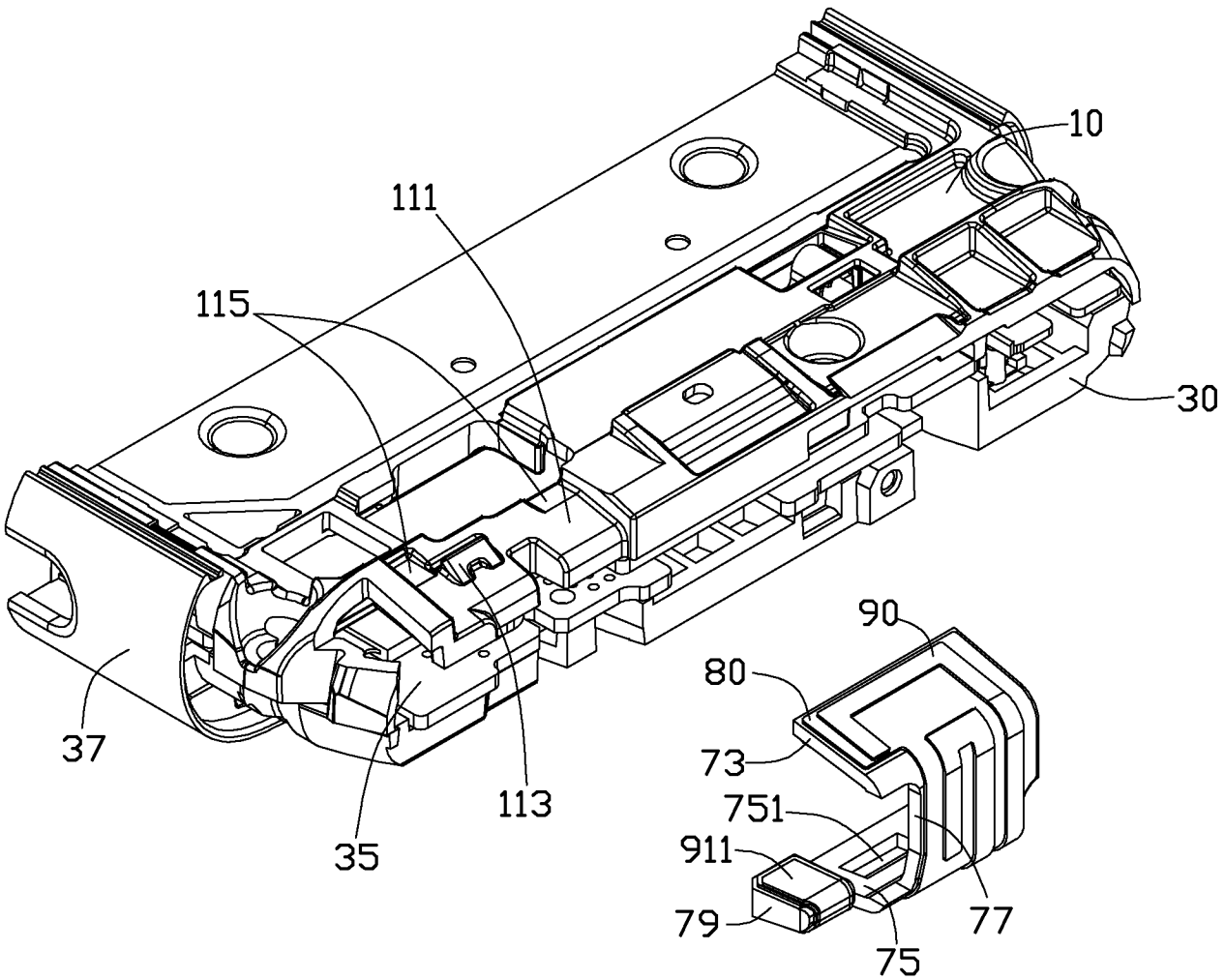
FIG. 3 is similar to FIG. 1, but showing the cover attached to the housing and the antenna module being assembled.

Also, referring to FIG. 3, the antenna 90 is fixed to the transparent film 80 by an adhesive, and the transparent film 80 is then fixed to the holder 70 by an adhesive. The U-shaped feed portion 911 is mounted on the block 79.

Figure 4:
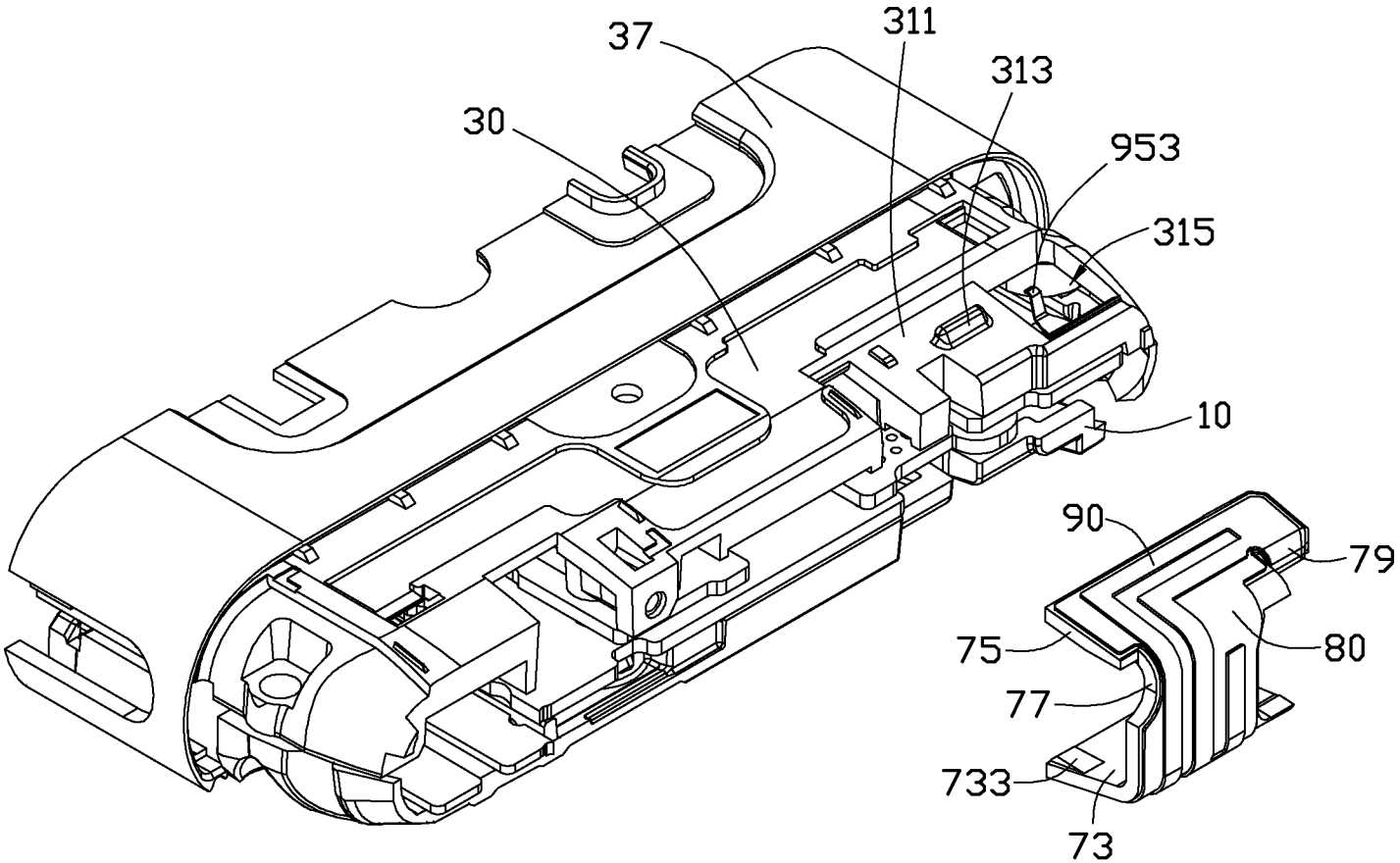
FIG. 4 is similar to FIG. 3, but shown from another aspect.
Figure 5:
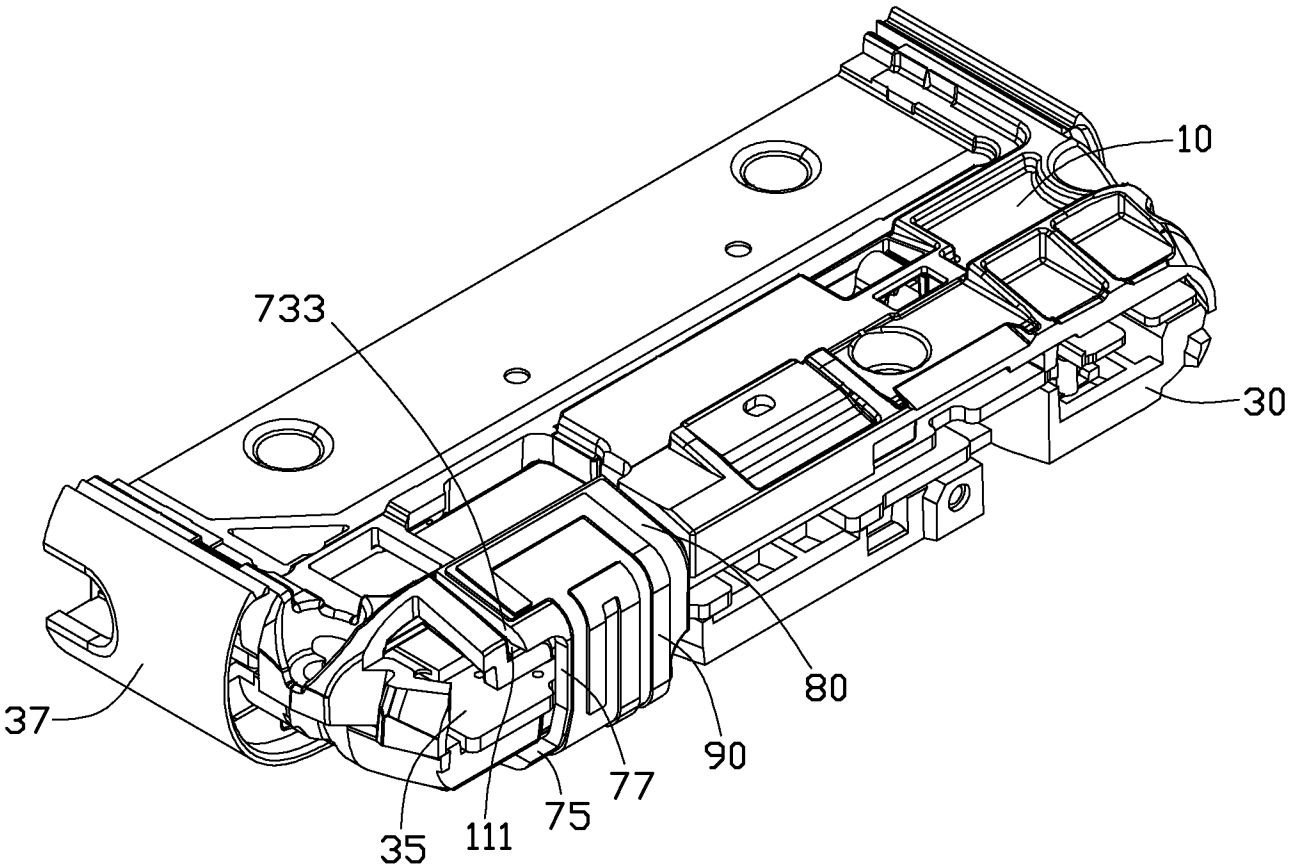
FIG. 5 is an assembled, isometric view of the portable electronic device with an antenna module, incorporated within.

Referring to FIGS. 4 and 5, to assemble the antenna module 200 to the portable electronic device 100, the cover 10 is attached to the housing 30 with two side edges thereof respectively inside the shells 37. The first end portion 73 is engaged in the recessed portion 111 of the cover 10. The second end portion 75 is engaged in the receiving portion 311 of the housing 30, and the two wedges 733 are respectively engaged in the two grooves 115. The protrusion 113 is engaged in the first latching hole 731, and the projecting portion 313 is engaged in the second latching hole 751. Thus, the antenna module 200 is fixed on the cover 10 and the housing 30.

The main plate 52 of the connector 50 extends through the through hole 315, and then are bent to clip the housing 30. The main plate 52 is electronically connected to the printed circuit board 35, and the finger end 54 electronically connects to the feed portion 911 of the antenna 90. Thus, the antenna 90 electronically connects with the printed circuit board 35.

It is to be understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A portable electronic device, comprising:

a main body including an upper surface and a lower surface, a recessed portion formed in the upper surface and having two sides and a receiving portion formed in the lower surface, the recessed portion defining two grooves, one groove being at each of the two sides of the recessed portion;

an antenna module including an antenna and a holder, the antenna attached to the holder, the holder including a first end portion and a second end portion, the first end portion having two sides, a wedge formed at each of the two sides of the first end portion, the first end portion engaged in the recessed portion, the second end portion engaged in the receiving portion, and each wedge engaged in one of the grooves; and a connector electronically connecting to the antenna.

2. The portable electronic device of claim 1, wherein a protrusion is formed on the recessed portion, the first end portion defines a first latching hole, and the protrusion is engaged in the first latching hole.

3. The portable electronic device of claim 2, wherein a projecting portion is formed on the receiving portion, the second portion define a second latching hole correspondingly, and the projecting portion is engaged in the second latching hole.

4. The portable electronic device of claim 3, wherein the main body defines a through hole allowing the connector to extend through, and two ends of the connector electronically connect a printed circuit board to the antenna.

5. The portable electronic device of claim 1, wherein the antenna module further comprises a transparent film, and the transparent film is positioned between the holder and the antenna.

6. The portable electronic device of claim 5, wherein the antenna comprises a feed portion, the feed portion is U-shaped, a block is formed adjacent to the second end portion, and the feed portion is mounted on the block.

7. The portable electronic device of claim 6, wherein the antenna further comprises a first radiator and a second radiator extending from the feed portion in space, and the first radiator and the second radiator have different lengths to generate signals of different resonant frequencies in response to radio frequency signals fed by the feed portion.

8. The portable electronic device of claim 4, wherein the main body comprises a cover and a housing, the recessed portion is positioned at the cover, the received portion is positioned at the housing, the printed circuit board is mounted on the housing, and the through hole is defined in the housing.

9. A portable electronic device, comprising:

a cover including a recessed portion, the recessed portion having two sides and defining two grooves, one groove being at each of the two sides of the recessed portion;

a housing including a receiving portion;

a printed circuit board mounted on the housing;

an antenna module including an antenna and a holder, the antenna attached to the holder, the holder including a first end portion and a second end portion, the first end portion having two sides, a wedge formed at each of the two sides of the first end portion, the first end portion engaged in the recessed portion, the second end portion engaged in the receiving portion, and each wedge engaged in one of the grooves; and a connector electronically connecting the printed circuit board to the antenna.

10. The portable electronic device of claim 9, wherein a protrusion is formed on the recessed portion, the first end portion defines a first latching hole, and the protrusion is engaged in the first latching hole.

11. The portable electronic device of claim 10, wherein a projecting portion is formed on the receiving portion, the second portion define a second latching hole correspondingly, and the projecting portion is engaged in the second latching hole.

12. The portable electronic device of claim 11, wherein the housing defines a through hole allowing the connector to extend through, and two ends of the connector electronically connect the printed circuit board and the antenna correspondingly.

13. The portable electronic device of claim 9, wherein the antenna module further comprises a transparent film, and the transparent film is positioned between the holder and the antenna.

14. The portable electronic device of claim 13, wherein the antenna comprises a feed portion, the feed portion is U-shaped, a block is formed adjacent to the second end portion, and the feed portion is mounted on the block.

15. The portable electronic device of claim 14, wherein the antenna further comprises a first radiator and a second radiator extending from the feed portion in space, and the first radiator and the second radiator different length to generate signals of different resonant frequencies in response to radio frequency signals fed in the feed portion.

16. A portable electronic device, comprising:

a cover including a protrusion and defining two grooves;

a housing including a projecting portion;

an antenna module including an antenna and a holder, the antenna attached to the holder, the holder defining a first latching hole and a second latching hole and including two wedges, the protrusion engaged in the first latching hole, the projecting portion engaged in the second latching hole, and each wedge engaged in one of the grooves.

17. The portable electronic device of claim 16, wherein the housing defines a through hole allowing the connector to extend through, and two ends of the connector electronically connect a printed circuit board and the antenna correspondingly.

18. The portable electronic device of claim 16, wherein the antenna module further comprises a transparent film, and the antenna is positioned between the holder and the transparent film.

19. The portable electronic device of claim 18, wherein the antenna comprises a feed portion, the feed portion is U-shaped, a block is formed adjacent to the second end portion, and the feed portion is mounted on the block.

20. The portable electronic device of claim 19, wherein the antenna further comprises a first radiator and a second radiator extending from the feed portion in space, and the first radiator and the second radiator different length to generate signals of different resonant frequencies in response to radio frequency signals fed in the feed portion.

* * * * *